US005813556A

United States Patent [19]

Onken

[11] Patent Number: 5,813,556

[45] Date of Patent: Sep. 29, 1998

[54] CASING SYSTEM FOR A TANK

[75] Inventor: Donald R. Onken, Easton, Ill.

[73] Assignee: Onken's LLC, Easton, Ill.

[21] Appl. No.: 799,863

[22] Filed: Feb. 13, 1997

[51] Int. Cl.[6] ..... B65D 6/12

[52] U.S. Cl. ..... 220/4.33

[58] Field of Search ..... 220/4.33, 4.29, 220/4.31, 4.34

[56] References Cited

U.S. PATENT DOCUMENTS

| | | | |
|---|---|---|---|
| 2,775,360 | 12/1956 | Phillips | 220/4.33 |
| 2,775,361 | 12/1956 | Kasdan | 220/4.33 |
| 4,796,392 | 1/1989 | Graham, Jr. | 220/4.33 |
| 5,279,436 | 1/1994 | Elliott et al. | 220/4.33 |
| 5,452,817 | 9/1995 | Taravella et al. | 220/4.33 |
| 5,497,895 | 3/1996 | Rudbach | 220/4.33 |

*Primary Examiner*—Joseph M. Moy
*Attorney, Agent, or Firm*—Leydig, Voit & Mayer, Ltd.

[57] ABSTRACT

A casing system for a tank such as a storage tank for restaurant cooking grease. The system includes a slotted bracket secured on each of four corners of a tank top, to each of the brackets corner supports are attached for holding exterior panels used to give the tank a finished appearance. The corner supports have bent portions, including terminal parts which are bent further into substantially an S-shape. A pocket or channel is created in the terminal parts of the supports into which the edges of plastic or fiberglass panels are received and held securely. The supports can be moved or adjusted slightly in the tank brackets to allow for fitting panels which have been cut slightly off-size and thereby save waste. The assembled panels and supports give a smooth, finished appearance to the tank.

8 Claims, 4 Drawing Sheets

CASING SYSTEM FOR A TANK

BACKGROUND OF THE INVENTION

The invention is directed to a novel system for joining exterior sheathing panels used to finish and trim a storage container or tank including adjustable corner supports. The adjustability of the corner bracket allows pre-cut exterior sheathing panels cut by a third party supplied to be "squared up" in order to provide as perfect a fit of the panels as is possible. In this way, if a panel were cut slightly oversize in one dimension, then the panel could still be fitted to the corner support brackets and the panel used instead of being discarded. The assembled unit offers a smooth, almost unitary, wall appearance.

PRIOR ART

The prior art shows no similar structural features to those disclosed herein. Tucker, U.S. Pat. No. 3,112,043 shows a container for storing liquid; it teaches holding exterior panels in place using an exo-skeletal framework provided by inner and outer scabs and for interlining pieces. Morrison U.S. Pat. No. 3,044,161 teaches a means of isolating a shipping container using a corner suspension system where each corner of a cubic container is supported by a hydraulic ram. Bjurling U.S. Pat. No. 4,376,494 discloses an insulated tank container having a framework to which hard insulation sheets are attached as by gluing. Sullivan U.S. Pat. No. 2,632,311 teaches an insulated container for frozen foods having built-up walls of corrugated paper or fiber boards. Reinforcement is provided by wires vertically and horizontally. Frederick et al U.S. Pat. No. 4,314,602 shows a knock-down storage tank held together by fasteners. The sidewalls butt together in mitered joints. Bauer U.S. Pat. No. 5,282,546 discloses an inner tank enclosed by an encapsulating outer tank held in spaced relation by spacers. Insulating material so as to create a firewall is disposed between the two tanks. Josselyn U.S. Pat. No. 5,335,815 shows a storage tank being held in a precast protective shell. Flexible containers of hardenable material are used to separate the tank from its precast outer shell. German OS No. 27 34 271 discloses a container having a framework which is inserted from the top into the container to support the walls and fixed to the container at the top.

OBJECTS OF THE INVENTION

It is a principle object of the invention to provide a novel means of encasing a tank which creates the appearance of a flush, unitary wall structure.

It is another object of the invention to provide a novel means of squaring up the sides of the container exterior walls by adjusting the corner brackets laterally.

It is still another object to provide a structure whose adjustability can compensate for poorly cut panels which are slightly larger (or smaller) than the ideal dimensions and thus avoid unnecessary waste of the wall structural panels.

It is yet another object to provide a container whose panels can be hand assembled in place by relatively unskilled labor.

It is a further object to provide a tank exterior wall that creates no gaps between wall and corner supports, thus avoiding problems with entry of bugs into those structural gaps, which is critical in sanitary operations, such as restaurants, which are subject to health inspections.

It is still another object of the invention to provide an inexpensive means of finishing the exterior appearance of a tank structure to make its appearance acceptable to the public and to restaurant owners and operators.

It is still another object of the invention to provide an inexpensive method of encasing the tank to create a finished product.

It is still another object of the invention to provide a corner support structure that can define a concealed compartment at the top of the tank to house away from the view and reach of restaurant personnel the electrical and mechanical components associated with a grease storage tank.

SUMMARY OF THE INVENTION

The invention comprises a novel system for joining exterior sheathing panels used to finish and trim a storage container or tank including adjustable cover supports. The adjustability of the corner bracket allows the exterior sheathing panels to be "squared up" in order to provide as perfect a fit of the panels as is possible with panels precut by a third party supplier. In this way, if a panel were cut slightly oversize in one dimension, then the panel could still be fitted to the corner support brackets and the panel used instead of being discarded. The assembled unit offers a smooth, almost unitary, wall appearance.

Restaurants have begun to use in-store storage tanks for the storage of grease collected from and disposed out of deep fryers. The tanks which have been built and installed thus far have been wrapped in stainless steel sheet material and have a welded seam with a motor and pump mounted on the top so as to be exposed to view. Naturally, such a construction provides a pleasant finished appearance (but for the exposed mechanicals) but it is very expensive to produce. Applicant's casing structure yields an attractive finished product at much lower cost than stainless steel since the sheathing can be of plastic sheets. In addition, applicant's structure lengthens the walls of the housing so that a compartment is established on top of the tank for mounting the pump, motor and other mechanical or electrical components hidden from view, giving the finished tank a better exterior appearance than prior art tanks.

DESCRIPTION OF PREFERRED EMBODIMENTS

Figure 1:
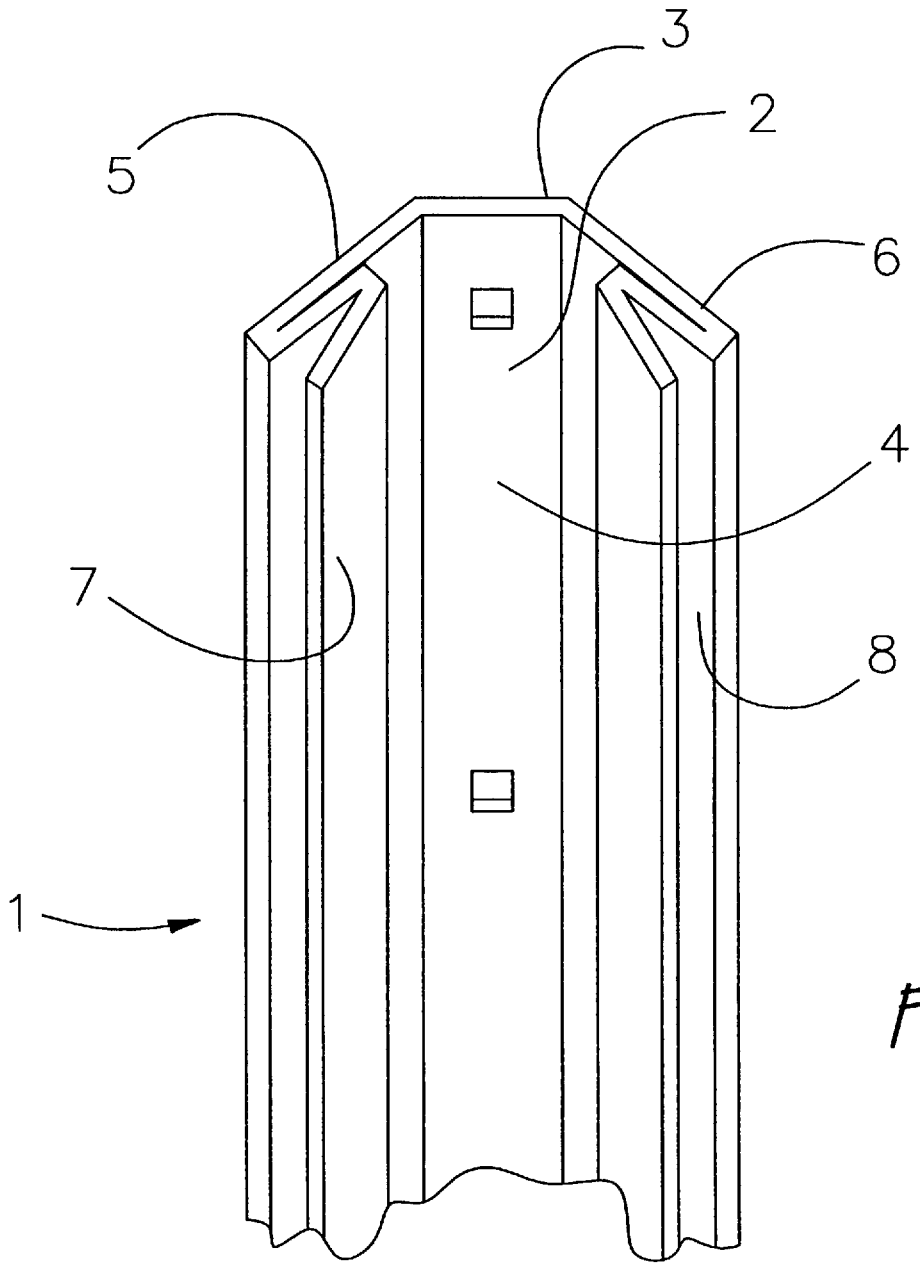
FIG. 1 shows a perspective view of the corner bracket used to support sheathing panels for a tank.
Figure 2:
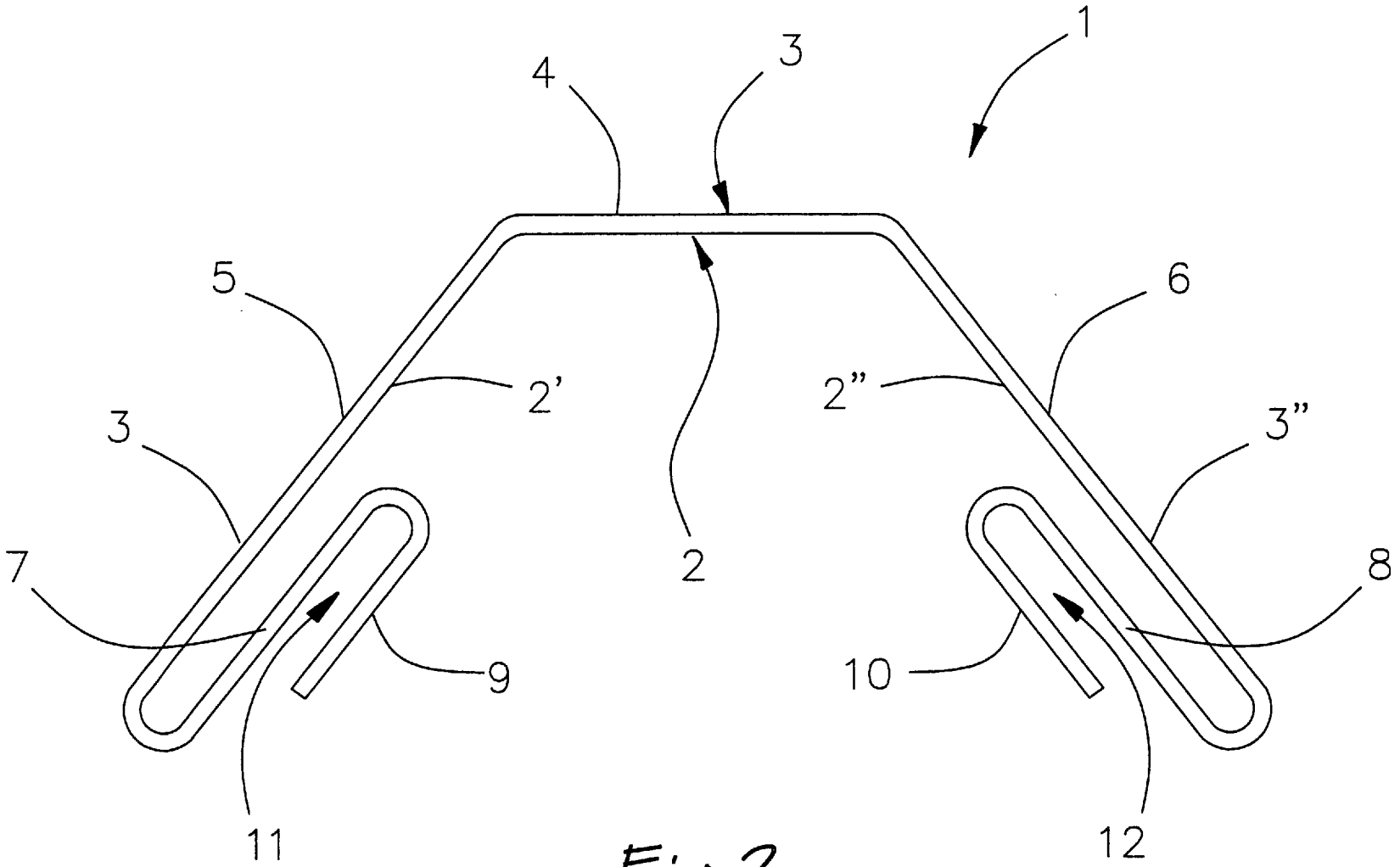
FIG. 2 shows a top plan view of the corner bracket.

Turning to FIG. 1, one sees a corner bracket 1 having inner wall portions 2, 2', 2", and an outer wall 3. The bracket s bent to create a three sided conformation having a central all 4 and flanking walls 5, 6, the flanking walls being bent at n obtuse angle to the central wall. The flanking walls include wall portions 7, 8 which are bent and re-bent upon themselves to create substantially an S shape, as best shown in FIG. 2. The wall portions 7, 8 are bent inwardly so as to lie substantially parallel to and along side the respective wall portion 3', 3". The wall portions 7 and 8 are shown spaced from the walls 5 and 6 to more clearly show the S-shape. The extremities 9, 10 of wall portions 7, 8 are themselves bent backwardly so as to lay substantially parallel to the respective wall portion 7, 8. The resulting bending and re-bending of the flanking walls of the bracket results in a S shape as shown in FIG. 2.

Figure 3:
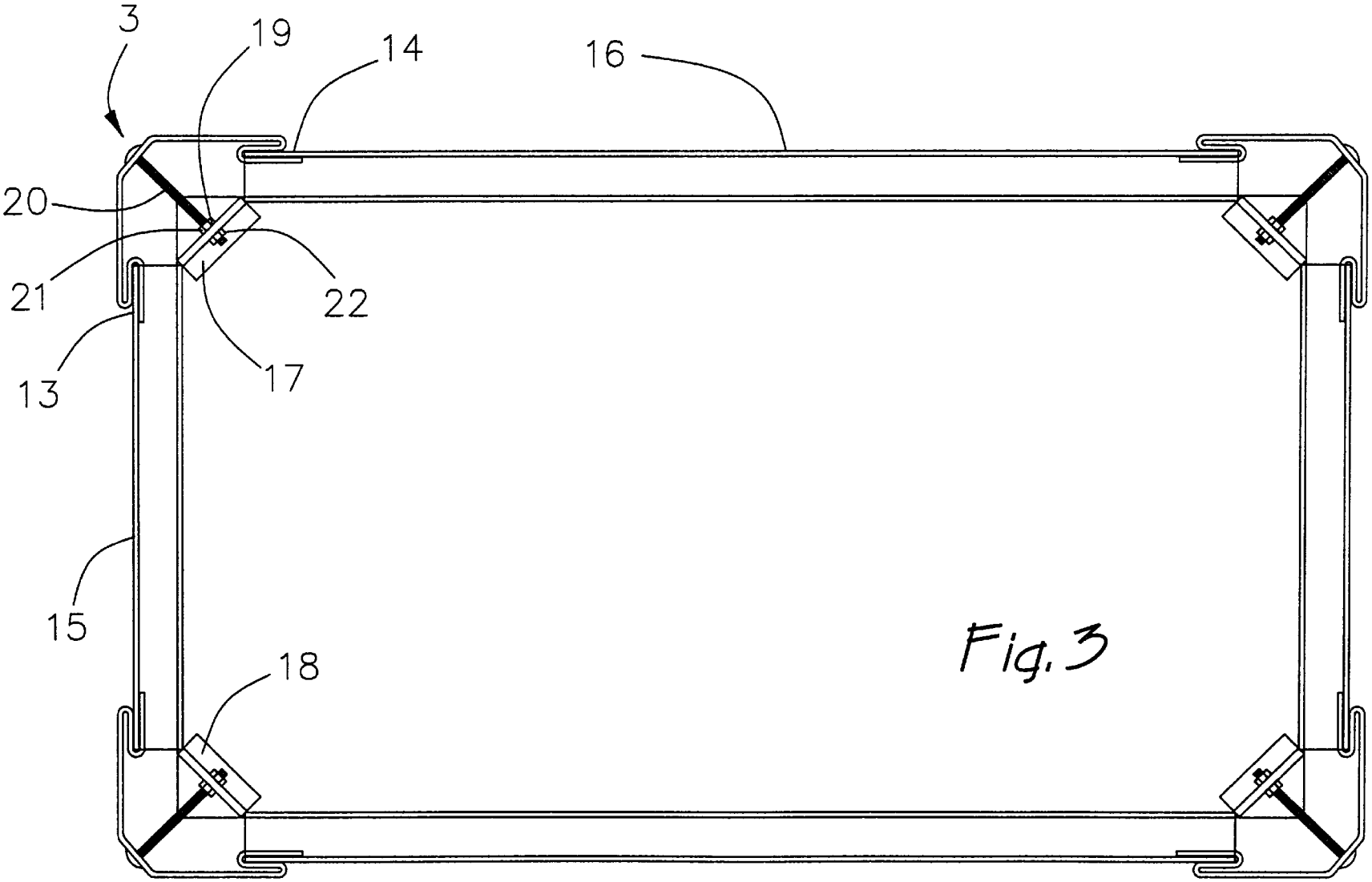
FIG. 3 shows a top plan view of the tank with the brackets and sheathing walls in place surrounding the tank.

Respective wall portions 7 and 9, and 8 and 10, lay in spaced parallel relation creating a pocket 11 between wall portions 7 and 9, and a pocket 12 between wall portions 8 and 10. These pockets allow the corner brackets to capture terminal portions 13, 14 of adjoining sheathing panels 15, 16 and hold the panels snugly in place as best shown in FIG. 3.

Figure 4:
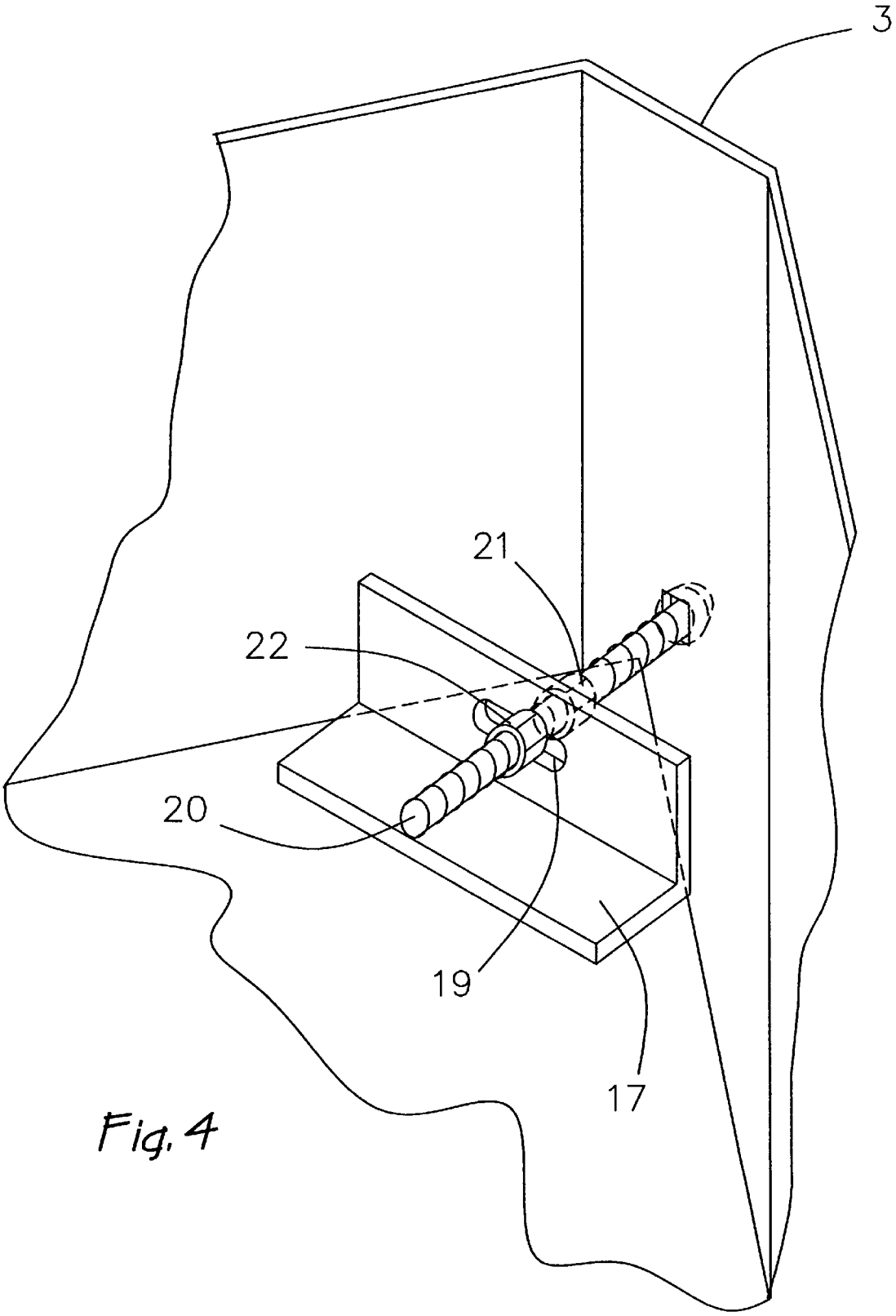
FIG. 4 shows a perspective view of a tank bracket to which the corner support can be secured.

As shown in FIG. 4, the tank includes supporting 90° angle brackets 17, 18 mounted diagonally between ends of adjacent walls of the tank and welded to the top wall of the tank itself with one leg of the bracket extended upwardly. Each bracket includes an elongated aperture 19 directed horizontally of the upwardly extending leg of the bracket and substantially medially thereof. The corner bracket is adapted to allow a bolt 20 mounted on the corner support to pass through the corner bracket and be held in place via inner and outer nuts 21, 22 disposed thereon. The inner nut is snugged up to the front of the corner bracket and the outer nut is snugged to the back of the corner bracket, thus holding the corner support in place and in spaced depth relation to the tank.

Insulation then may be placed between the tank and the sheathing walls to retain heat in the tank, if it is a heated tank. Otherwise, the void created between the tank and the sheathing walls which this structure allows may be made small and the insulation dispensed with.

In mounting the sheathing panels in the corner supports, all corner supports are installed by the tank brackets so as to offstand at a standard desired depth. Then the sheathing panels, which preferably are thin plastic or fiberglass sheets, are slipped from the top into the pockets 11, 12 of a pair of corner supports mounted on opposite corners of a same side of the tank. Depending upon the alignment of the sides and the dimensions of the four panels being used, the sheathing panels may be adjusted for fit by loosening an outer nut 22 on one of a desired bolt 20 to allow the corner support to be shifted laterally in the elongated aperture 19 so as to improve the alignment and fit of the sheathing panels.

Thus, this system allows the constructor of the tank exterior wall structure to finesse the fit and alignment of the walls of the tank sheathing to improve the appearance of the finished tank and to tighten the interfitting connections between the sheathing walls and the corner bracket. A bonus feature of this system is that if a panel is pre-cut slightly oversize or undersize the constructor can adjust the corner supports holding that panel to allow its use rather than causing a miscut to become waste.

The foregoing relates to preferred exemplary embodiments of the invention, it being understood that other variants and embodiments thereof are possible within the spirit and scope of the invention, the latter being defined by the appended claims.

What is claimed and desired to be secured by U.S. Letters Patent is:

1. A novel system for joining exterior sheathing panels opposite each side of a tank to improve an appearance of the tank which comprises an elongated corner bracket having sides which are substantially at an angle of about 90° to each other, each side of said corner bracket has a S-shaped terminal end along the length thereof, each said S-shaped terminal end including a pocket (11, 12) along the length thereof, a supporting bracket secured to an upper wall at each corner of said tank near the corner and at a same angle relative to adjacent sides of said tank and means for securing an elongated corner bracket to said supporting bracket at each corner of said tank whereby said sheathing panels can be slid into said pockets 11, 12 of said corner brackets to enclose said tank with said sheathing panels spaced from said sides of said tank.

2. A wall joining system as set forth in claim 1, in which said supporting bracket has one leg perpendicular to the upper surface of said tank, and said one leg includes a horizontal slot for adjusting said corner bracket relative to said supporting bracket.

3. A wall joining system as set forth in claim 1, in which each of said corner brackets have a straight corner wall which is at an obtuse angle relative to the sides of said corner bracket.

4. A wall joining system as set forth in claim 2, in which each of said corner brackets have a straight corner wall which is at an obtuse angle relative to the sides of said corner bracket.

5. A wall joining system as set forth in claim 3, in which said obtuse angle is about 135°.

6. A wall joining system as set forth in claim 4, in which said obtuse angle is about 135°.

7. A wall joining system as set forth in claim 4, which includes a bolt means that extends through said straight corner wall and fits into said one leg of said bracket, and said bolt means is secured in place by at least one nut means.

8. A wall joining system as set forth in claim 7, which includes a first nut means on one side surface of said one leg and a second nut means on a second side surface of said one leg, whereby said first and second nut means are adjusted relative to said one leg in order to support said corner bracket in place which in turn supports said sheathing panels in place in spaced relation to said tank.

* * * * *